United States Patent [19]

Thurston

[11] 3,961,610

[45] June 8, 1976

[54] EXHAUST GAS RECIRCULATION CONTROL SYSTEM

[75] Inventor: Kelly W. Thurston, Okemos, Mich.

[73] Assignee: General Motors Corporation, Detroit, Mich.

[22] Filed: Oct. 29, 1974

[21] Appl. No.: 518,820

[52] U.S. Cl. ..... 123/119 A; 123/122 D; 261/50 A

[51] Int. Cl.² ..... F02M 25/06

[58] Field of Search ..... 123/119 A, 122 D; 261/50 A

[56] References Cited

UNITED STATES PATENTS

| | | | |
|---|---|---|---|
| 3,459,163 | 8/1969 | Lewis | 123/122 |
| 3,844,260 | 10/1974 | Scott, Jr. et al. | 123/119 A |
| 3,861,367 | 1/1975 | Kelmar | 123/119 A |
| 3,868,934 | 3/1975 | Mick | 261/50 A |
| 3,882,206 | 5/1975 | Gural et al. | 261/50 A |

*Primary Examiner*—Charles J. Myhre
*Assistant Examiner*—S. Richter
*Attorney, Agent, or Firm*—Arthur N. Krein

[57] ABSTRACT

An air valve, in the snorkel leading to the air cleaner in the induction system of an internal combustion engine, is actuated by a vacuum operated servo controlled by the depression in the snorkel to maintain a constant depression at the air cleaner. An exhaust gas recirculation control valve, operated by the air valve control servo, opens proportional to air valve opening to control exhaust gas flow into the induction system proportional to exhaust back pressure and air valve opening thereby providing exhaust gas recirculation flow proportional to engine load.

7 Claims, 2 Drawing Figures

EXHAUST GAS RECIRCULATION CONTROL SYSTEM

Figure 1:
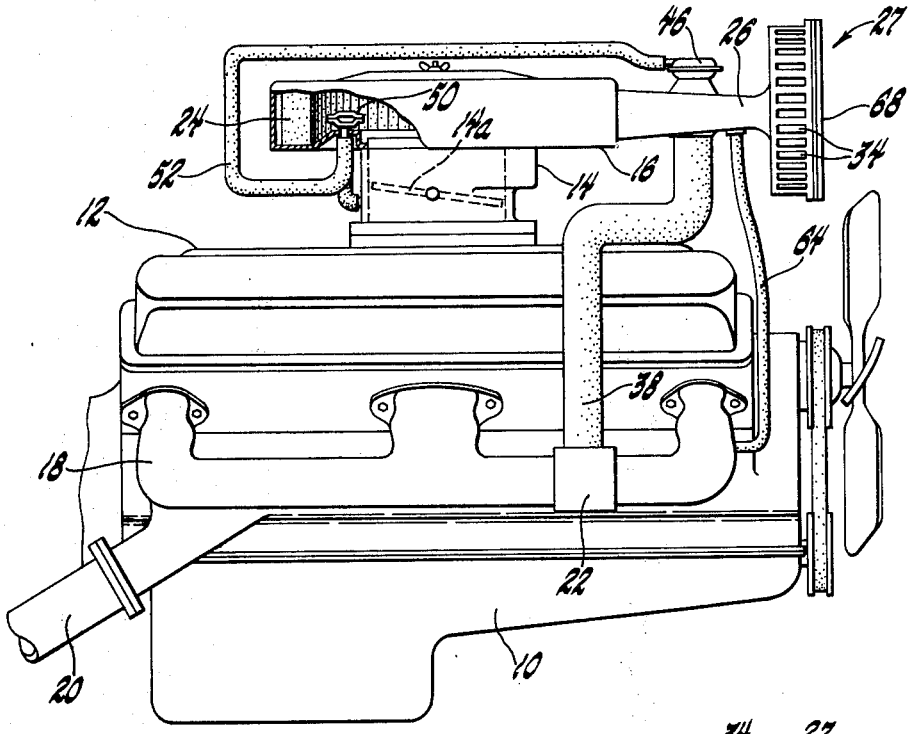

This invention relates to an emission control system for an internal combustion engine and, in particular, to an exhaust gas recirculation control system for such an engine.

A variety of systems have been proposed for recirculating internal combustion engine exhaust gases to the engine induction system. The recirculated exhaust gases, together with the residual exhaust gases in the combustion chambers, dilute the air-fuel mixture to inhibit formation and emission of oxides of nitrogen during engine operation.

In general, such systems attempt to proportion the flow of exhaust gases to the flow of combustion air through the induction system of the engine. Thus, valves controlling the flow of recirculated exhaust gases have been positioned in response to various variables, such as throttle position or induction passage vacuum at a throttle traversed port. These two above-identified variables have been used to effect positioning of the valve controlling the flow of recirculated exhaust gases in an engine since, at engine idle where no recirculation is needed, these variables are very effective as a means of preventing valve opening for the flow of recirculated exhaust gases during engine idle. However, to use either of these variables requires that part of the control system for the exhaust gas recirculation valve must necessarily be operatively connected in a suitable manner to the operating mechanism of the carburetor for the engine.

It is therefore the primary object of this invention to improve an exhaust gas recirculation control system whereby the valve controlling the flow of recirculated exhaust gas is positioned in the induction passage upstream of the air cleaner leading to the carburetor for the engine, this valve being controlled by the servo mechanism of an air valve positioned in the snorkel of the induction system upstream of the thermostatically controlled air cleaner.

Another object of this invention is to improve an exhaust gas recirculation control system by attaching the movable valve element of an exhaust gas recirculation control valve to an air valve attached to the snorkel of the air cleaner for an internal combustion engine whereby at a predetermined air flow to the engine, corresponding to a given air valve opening, the exhaust gas recirculation control valve would open proportional to air valve opening.

These and other objects of the invention are obtained by the use of an air valve attached to the thermostatically controlled air cleaner for an internal combustion engine, this air valve maintaining a constant depression in the air cleaner by means of a vacuum operated servo controlled by the depression in the snorkel, a movable element of the servo having an exhaust gas recirculation valve element connected thereto to control the flow of recirculated exhaust gas as a function of air valve opening.

Figure 2:
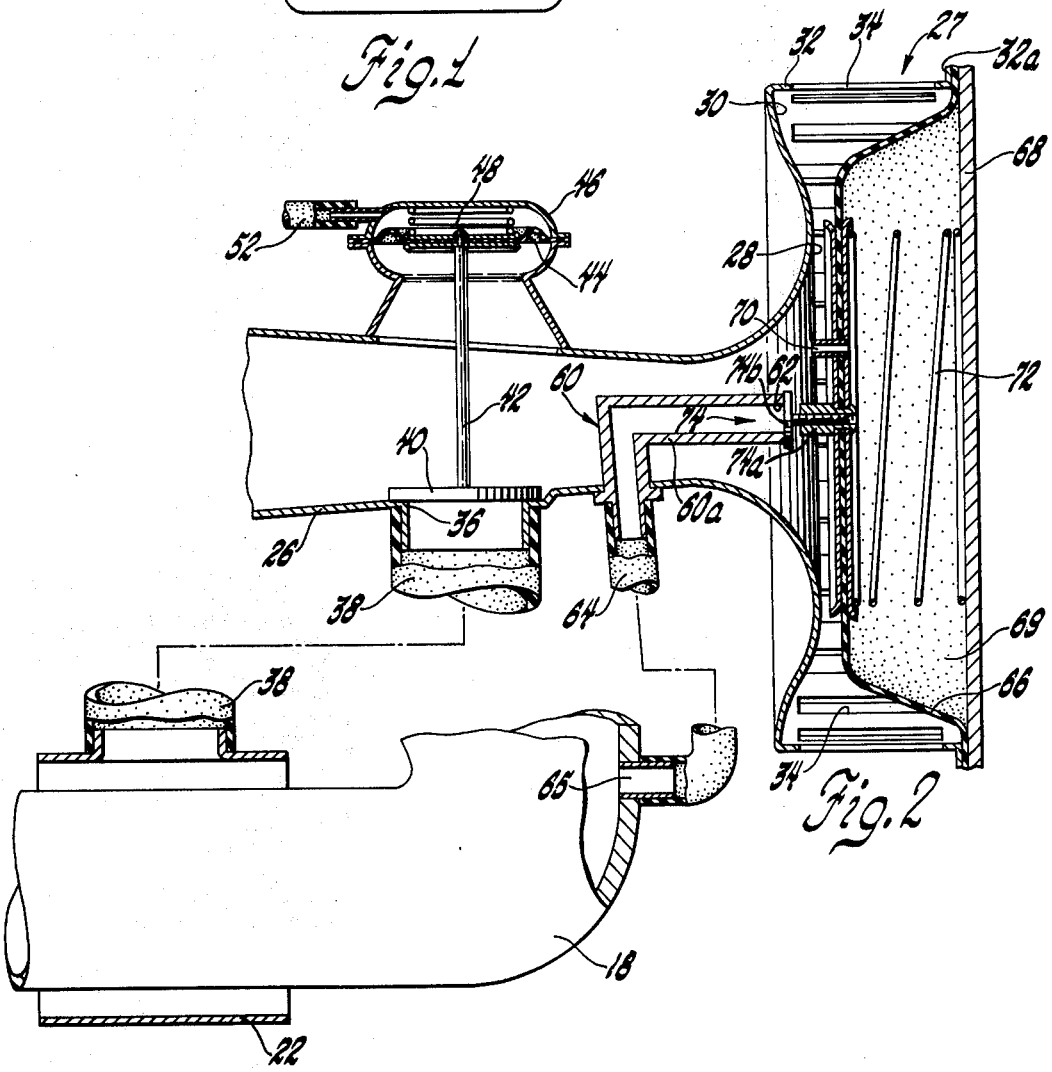

For a better understanding of the invention, as well as other objects and further features thereof, reference is had to the following detailed description of the invention to be read in connection with the accompanying drawings, wherein:

FIG. 1 is a side elevational view of an internal combustion engine which has a thermostatically controlled air cleaner adapted to control the temperature of the induction air flow and an exhaust gas recirculation control system in accordance with the invention placed in the snorkel leading to the air cleaner; and, FIG. 2 is an enlarged view with parts broken away to show the thermostatic control and air flow control valve together with the exhaust gas recirculation control system for the engine.

Referring first to FIG. 1, an internal combustion engine 10 includes an intake manifold 12 and a carburetor 14 on which an air cleaner and silencer assembly 16 is mounted. Engine 10 also includes an exhaust manifold 18 which discharges through an exhaust pipe 20. A stove 22 is disposed about either the exhaust manifold 18, as shown, or exhaust pipe 20 to provide a source of heated air.

The air cleaner and silencer assembly 16 defines a silencing chamber internally thereof within which an air filler element 24 is disposed and, this assembly has an outlet, not shown, which registers with the inlet, not shown, of the carburetor 14 and an inlet opening in communication with the discharge end of a tuned conduit or snorkel 26, the opposite end or inlet end of the snorkel being provided with an inlet air valve, generally designated 27, open to air at ambient or under hood temperatures. The inlet air valve 27 in effect provides a variable area inlet for the snorkel and, broadly defined, includes a pair of walls, one of which is fixed while the other is movable relative to the fixed wall, the movable wall being positioned by a differential pressure actuated servo mechanism, of which the movable wall may be a part in accordance with air pressure on the downstream side of this valve. The air valve 27 may be formed as a separate element fixed to the snorkel or, as shown, may be formed in part integral with the flared end of the snorkel. In the embodiment shown, as best seen in FIG. 2, the snorkel 26 at its inlet end is provided with a flared annular end 28 which, as will be described in detail hereinafter, defines a valve seat portion of the inlet air valve, the flared end 28 being return bent, as at 30, and then forwardly bent to provide an inlet rim 32 provided with circumferentially spaced apart axial extending inlet slots 34 for the ingress of air.

The snorkel 26 also has a lateral opening 36 to which a conduit 38, shown in the form of a hose, is connected to supply warmed air from the stove 22, with air flow through this lateral opening into the snorkel being controlled by a hot air valve 40. Valve 40 is secured by a rod 42 to the diaphragm 44 of a vacuum motor 46 and is normally biased to the closed position relative to opening 36, the position shown in FIG. 2, by a spring 48 acting against diaphragm 44. As vacuum signals above about six inches Hg are applied to the chamber on the upper side of the diaphragm 44 against the force of spring 48, the valve 40 is lifted from the position shown in FIG. 2 to allow the flow of heated air into the snorkel 26 from the heat stove 22. As shown, in FIG. 1, a suitable thermostatic control 50 is provided for controlling the flow of vacuum signals through a line 52 connected at one end to the vacuum chamber of the vacuum motor 46 and at its other end to the induction passage, not shown, below the throttle 14a of the carburetor 14. The thermostat, shown only schematically in FIG. 1, may be of any suitable type, as desired, and for example may be of the type as shown in U.S. Pat. No. 3,459,163 for "Thermostatic Control" issued Aug. 5, 1969 to Donald B. Lewis, the disclosure of which is incorporated herein by reference thereto.

In operation, as described in the above-identified U.S. Pat. No. 3,459,163, the thermostatic control 50, which is located in the chamber of the air cleaner 16, senses the temperature of induction air flow and, under low temperatures, permits engine vacuum flow to vacuum motor 46 whereby this motor positions valve 40 solely in accordance with variations in induction vacuum. Under these conditions, during wide open throttle operation, the valve of induction vacuum is sufficiently low that the spring 48 of the vacuum motor 46 is effective to move the valve 40 to the closed position shown in FIG. 2 whereby only cool air is delivered to the engine for maximum power; during most modes of engine operation, however, valve 40 is unseated allowing heated air from stove 22 to flow into the snorkel.

As the induction air flow temperature rises, the flow of vacuum to the vacuum motor 46 is, in effect, reduced by operation of the thermostatic control 50 whereby valve 40 is repositioned to reduce the flow of heated air through lateral opening 36 thereby permitting an increased flow of ambient air through the inlet end of the snorkel 26, and, specifically through air valve 27 to the snorkel.

Referring now to the subject matter of the invention relative to the flow control of the recirculation of exhaust gases, an exhaust gas recirculation valve, generally designated 60, includes a conduit 60*a* that is fixed to snorkel 26 and positioned with the outlet end thereof mounted in the interior of the snorkel upstream of the hot air valve 40, the flared outlet orifice or opening 62 of this conduit forming a valve seat being positioned substantially concentric to the longitudinal axis of the snorkel 26 and closely adjacent to the flared open end 28 of the snorkel. The opposite end of this conduit 60*a* extends radially through the wall of the snorkel to be connected by a suitable conduit, such as hose 64, to a discharge pipe nipple 65 extending through a wall of the exhaust manifold 18 whereby exhaust gases may be supplied to the snorkel upstream of the hot air valve and, of course, upstream of the air cleaner for subsequent delivery to the carburetor of the engine. Flow of exhaust gases from the conduit 60*a* is effected by means of the valve element 74 suitably connected to a diaphragm 66 forming part of a differential pressure actuated servo mechanism of a vacuum operated air valve 27, to be described, controlling the flow of ambient air to the engine.

As shown in FIG. 2, the outer inlet end of the snorkel in the form of an annular shell formed by inlet rim 32 with the plurality of inlet openings or slots 34 therethrough terminates in a radially outward extending flange 32a against which the outer peripheral end of roll diaphragm 66 is retained by the closed disk member 68 suitably secured to the flange 32a, the diaphragm 66 being thus sealingly sandwiched therebetween to form with the flared end 28 of the snorkel a variable area passage of annular configuration for the flow of ambient air radially inward to the interior of the snorkel, the effective flow area of this opening being a function of the spacing between this flared end 28 of the snorkel and the opposing surface on one side of the diaphragm 66. Diaphragm 66 with cover 68 forms a pressure chamber 69 which is connected by a snorkel vacuum tube 70 which extends through the diaphragm 66 to the interior of snorkel 26 downstream of the air valve whereby this pressure chamber is in communication with the air flow pressure in the snorkel.

A coiled compression spring 72, of a predetermined force, positioned within the pressure chamber 69 abuts at one end against the disk cover 68 and at its other end against the diaphragm 66 to normally bias the diaphragm in a direction, to the left as seen in FIG. 2, to reduce the effective area of this annular air valve inlet opening into the snorkel.

As best seen in FIG. 2, the one side of diaphragm 66, opposite to that exposed to the pressure in pressure chamber, is exposed over a predetermined area to substantially ambient air pressure while another predetermined area on this side of the diaphragm is exposed to the air pressure within the snorkel, while of course the entire exposed surface area on the opposite side of this diaphragm is exposed to the pressure in pressure chamber 69. In addition, the valve element 74, of the exhaust gas recirculation valve 60, used to control exhaust gas flow through the outlet opening 62 of the conduit 60a of this valve, is fixed to the diaphragm 66, preferably in the center thereof, for movement therewith in an axial direction aligned with the axis of outlet opening 62. Preferably valve element 74 is adjustable and, for example, may be formed, as shown, as a two-piece element with a stem 74*a* fixed to the diaphragm 66 and with a suitable valve element 74*b* adjustably secured thereto to permit axial adjustment of the latter so that this exhaust gas control valve element 74*b* would close outlet opening 62, during idle engine operation.

The air valve 27 can be constructed so that the roll diaphragm 66 will seat against the axial forward extension of flared end 28 in which case a bypass valve or orifice, not shown, around the air valve would be required to permit sufficient flow of ambient air into the snorkel for idle engine operation or, as shown, the air valve can be constructed so that the diaphragm 66 will not fully seat against the flared end 28 to thereby allow a small amount of ambient air to flow through the thus limited passage opening of this air valve into the snorkel for use during engine idle. This can be accomplished by providing a suitable stop for the movement of diaphragm 66 in a direction toward the flared end 28 as by using valve 74 seating in the flared opening 62 of conduit 60a as the stop whereby the diaphragm 66 is at all times spaced at least a short distance from the flared end 28.

With the above described arrangement, the air valve 27 is operative to maintain a constant depression in the air cleaner 16 by means of the vacuum operated servo mechanism of the air valve as controlled by the depression in the snorkel 26 which is communicated via snorkel vacuum tube 70 to the pressure chamber of the servo mechanism to act against the biasing force of spring 72. Thus, as air flow through the valve to the engine increases, the diaphragm 66 lifts, that is, moves to the right as seen in FIG. 2, from the seat or flared end 28 of the air valve to maintain a constant depression in the snorkel 26 and, therefore, in air cleaner 16.

By attaching the movable element of the exhaust gas recirculation valve, that is, valve 74 to the movable element or diaphragm 66 of the air valve, there is provided a method of controlling exhaust gas recirculation flow into the snorkel air stream. As previously described, the valve 74 is adjusted to close the outlet opening 62 at engine idle air flow. With this arrangement, at a predetermined air flow, corresponding to a predetermined air valve 27 opening, the exhaust gas recirculation valve would be open proportional to air valve opening and, therefore, controlling exhaust gas recirculation flow proportional to exhaust back pressure and air valve 27 opening. This will then provide exhaust gas recirculation flow proportional to engine load.

In operation, assuming low temperature ambient air, as the engine is started, the thermostatic control 50 will sense the low temperature of the induction air flow and, accordingly, would operate to allow a vacuum signal to be applied to the valve motor 46 and, as vacuum signals above about 6 inches of mercury Hg are applied to the diaphragm 44 against the force of spring 48 of this motor, the valve 40 is opened accordingly to allow heated air from the stove 22 to flow into the snorkel and effectively eliminating cold air flow during warmup, except at high loads as previously described.

Under the above operating conditions during part throttle engine warmup, there would be no exhaust gas recirculation flow because the open hot air valve 40 will be effective to drop snorkel vacuum adjacent snorkel vacuum tube to zero since the flow of cold air to the engine is substantially eliminated.

As the induction air flow temperature rises, the thermostatic control 50 is operative to effect repositioning and eventual closing of valve 40, thus permitting an increased flow of ambient air through the air valve 27 into the snorkel 26. Then, at engine operation, other than at idle, the exhaust gas recirculation flow will be proportional to air flow to the engine in the manner previously described. In the event of wide open throttle operation during warmup, as previously described, the vacuum motor is effective to move the valve 40 to the closed position, whereby only cool air flowing through air valve 27 is delivered to the engine. As this happens, the exhaust gas recirculation valve 60 will open, as described, to provide for the flow of exhaust gases to the engine for detonation control.

What is claimed is:

1. An internal combustion engine comprising an induction passage for air flow to the engine, an exhaust passage for exhaust flow from the engine, said induction passage including a throttle controlled carburetor, an air cleaner upstream of said carburetor and a snorkel having an outlet at one end to said air cleaner and a variable area air inlet means at its opposite end open to ambient air, said variable area air inlet means including a fixed first wall and a differential pressure responsive valve means including a valve member movable relative to said first wall to define a variable area inlet for ambient air flow into said snorkel, said differential pressure responsive valve means including servo means operative as a function of air pressure in said snorkel immediately downstream of said variable area air inlet means, an exhaust gas passage means extending from said exhaust passage to said snorkel, said exhaust gas passage means including an outlet orifice in said snorkel opening toward and positioned closely adjacent to said variable area air inlet means and, an exhaust gas recirculation control valve fixed to said valve means for movement therewith and positioned in axial alignment with said outlet orifice for movement relative to said outlet orifice to control the exhaust gas recirculation flow through said outlet orifice into said snorkel.

2. An internal combustion engine according to claim 1 wherein said snorkel has an opening into it intermediate its ends and located downstream of said outlet orifice, and further comprising conduit means connected to said opening and to a source of air warmed to temperatures greater than ambient, a hot air valve movably positioned in said snorkel to control flow through said opening into said snorkel and, thermostatically controlled valve operating means connected to said hot air valve for effecting movement of said hot air valve relative to said opening and operative as a function of air pressure in said induction passage immediately downstream of said throttle and air temperature in said induction passage upstream of said carburetor to effect positioning of said hot air valve relative to said opening.

3. An internal combustion engine comprising an induction passage for air flow to the engine, said induction passage including a carburetor with a throttle therein and a snorkel having an inlet and an outlet to an air cleaner upstream of said carburetor, an exhaust passage for exhaust gas flow from the engine, passage means connecting said exhaust passage to said snorkel for recirculation of exhaust gases from said exhaust passage to said induction passage, said passage means including an orifice opening positioned closely downstream of said inlet of said snorkel, an exhaust gas recirculation control valve movably positioned relative to said orifice opening for varying the exhaust gas flow area from said orifice opening to thereby control recirculation of exhaust gases, an air valve including movable valve means positioned in said inlet of said snorkel for varying the air flow area therethrough at air flow rates above those required for idle engine operation, a differential pressure operated servo means connected to said air valve to maintain a substantially constant depression in said snorkel downstream of said air valve whereby the position of said movable valve means is a measure of the rate of air flow through said inlet of said snorkel, and means linking said movable valve means and said exhaust gas recirculation control valve for corresponding movement whereby the position of said exhaust gas recirculation control valve relative to said orifice opening is determined by the rate of air flow, above the air flow rate at engine idle, through said induction passage and recirculation of exhaust gases is appropriately controlled in accordance therewith.

4. An internal combustion engine according to claim 3 wherein said snorkel has an opening therein downstream of said orifice opening, and further comprising conduit means connected to said opening and to a source of air warmed to temperatures greater than ambient, a hot air valve movably positioned in said snorkel to control flow through said opening into said snorkel and, thermostatically controlled valve operating means connected to said hot air valve for effecting movement of said hot air valve relative to said opening and operative as a function of air pressure in said induction passage immediately downstream of said throttle and air temperature in said induction passage upstream of said carburetor to effect positioning of said hot air valve relative to said opening.

5. An internal combustion engine comprising an induction passage including an air cleaner and a snorkel with an air valve controlled inlet open to ambient air for air flow to the engine, a throttle disposed in said induction passage downstream of said air cleaner for controlling air flow requirements therethrough, an exhaust passage for exhaust gas flow from the engine, conduit means connecting said exhaust passage to said induction passage, said conduit means including an orifice opening closely adjacent to and downstream of said air valve controlled inlet, a control valve movable to various positions relative to said orifice opening for varying the exhaust gas flow area therethrough to thereby control recirculation of exhaust gases, said air valve controlled inlet including a fixed wall and a movable wall movable to various positions relative to said fixed wall for varying the air flow area therethrough, a differential pressure operated servo means operatively associated with said movable wall for positioning said movable wall to maintain a substantially constant pressure depression in said snorkel downstream of said air valve controlled inlet whereby the position of said movable wall is a measure of the rate of air flow through said induction passage, and means linking said movable wall and said control valve for proportional movement whereby the position of said control valve relative to said orifice opening is determined by the rate of air flow through said snorkel immediately downstream of said air valve controlled inlet and recirculation of exhaust gases is appropriately controlled in accordance therewith.

6. An internal combustion engine according to claim 5 wherein said snorkel further includes a secondary air valve controlled inlet, said secondary air valve controlled inlet including an opening into said snorkel downstream of said orifice opening, a conduit means connected to said opening and to a source of air warmed to temperatures greater than ambient, a hot air valve movably positioned in said snorkel to control flow through said opening into said snorkel and, thermostatically controlled valve operating means connected to said hot air valve for effecting movement of said hot air valve relative to said opening and operative as a function of air pressure in said induction passage immediately downstream of said throttle and air temperature in said induction passage upstream of said throttle to effect positioning of said hot air valve relative to said opening.

7. An internal combustion engine comprising an induction passage including an air cleaner, with a snorkel thereon, mounted upstream of a throttle controlled carburetor for air flow to the engine, said snorkel having an air valve controlled inlet at one end thereof open to air at ambient temperatures, an exhaust passage for exhaust flow from the engine, said snorkel having an opening therein downstream of said air valve controlled inlet, conduit means connected to said opening and to a source of air warmed to temperatures greater than ambient, a hot air valve movably positioned to control flow through said opening into said snorkel, thermostatically controlled valve operating means operatively connected to said hot air valve for effecting movement of said hot air valve and including a pressure responsive means connected to said hot air valve and to said induction passage downstream of said throttle, an exhaust gas circulating passage means extending from said exhaust passage with an outlet orifice in said snorkel opening toward and positioned closely adjacent to said air valve controlled inlet upstream of said opening, said air valve controlled inlet including an annular flared valve seat, a closed disk member fixed in spaced apart relation to said flared valve seat and, a diaphragm means sandwiched therebetween, said diaphragm means forming with said flared valve seat a variable area annular inlet open at its radially inward end into said snorkel and open at its outer periphery to ambient air, said diaphragm means forming with said closed disk member a pressure chamber, spring means positioned in said pressure chamber to normally bias said diaphragm means in a direction toward said flared valve seat, a snorkel vacuum tube fixed to said diaphragm means and extending therethrough with one end downstream of said variable area annular air inlet and the opposite end in said pressure chamber and, a valve element fixed to said diaphragm for movement therewith, said valve element being positioned on said diaphragm in axial alignment with said outlet orifice and movable relative thereto to control the exhaust gas recirculation flow through said outlet orifice into said snorkel.

* * * * *